US006786744B1

(12) United States Patent
Lee

(10) Patent No.: US 6,786,744 B1
(45) Date of Patent: Sep. 7, 2004

(54) CONCENTRIC PLUG

(76) Inventor: Chang Woo Lee, Aju apt. 6-205, 72-2 Bakchon-Dong, Geyang-Ku, Incheon city (KR)

( * ) Notice: Subject to any disclaimer, the term of this patent is extended or adjusted under 35 U.S.C. 154(b) by 0 days.

(21) Appl. No.: 10/203,612

(22) PCT Filed: May 30, 2000

(86) PCT No.: PCT/KR00/00562

§ 371 (c)(1),
(2), (4) Date: Aug. 16, 2002

(87) PCT Pub. No.: WO01/82417

PCT Pub. Date: Nov. 1, 2001

(30) Foreign Application Priority Data

Feb. 24, 2000 (KR) ..... 2000-0008926

(51) Int. Cl.[7] ..... H01R 13/44
(52) U.S. Cl. ..... 439/137
(58) Field of Search ..... 439/137–139

(56) References Cited

U.S. PATENT DOCUMENTS 4,094,569 A * 6/1978 Dietz ..... 439/137
4,722,693 A * 2/1988 Rose ..... 439/137
4,770,643 A * 9/1988 Castellani et al. ..... 439/135
4,867,694 A * 9/1989 Short ..... 439/137
4,932,886 A * 6/1990 Glaser ..... 439/137
5,006,075 A * 4/1991 Bowden, Jr. ..... 439/137
5,020,997 A * 6/1991 Calderara et al. ..... 439/137
5,066,238 A * 11/1991 Shieh ..... 439/139
5,281,156 A * 1/1994 Yi ..... 439/137
5,702,259 A * 12/1997 Lee ..... 439/137
5,746,612 A * 5/1998 Chien-Yuan ..... 439/139
5,915,981 A * 6/1999 Mehta ..... 439/137
5,984,700 A * 11/1999 Chang ..... 439/139
6,015,306 A * 1/2000 Jen ..... 439/139
6,149,446 A * 11/2000 Yu ..... 439/137
6,224,401 B1 * 5/2001 Yu ..... 439/139
6,238,224 B1 * 5/2001 Shao ..... 439/137

FOREIGN PATENT DOCUMENTS

| | | |
|---|---|---|
| JP | 5-54929 | 3/1993 |
| KR | 86-8838 | 7/1986 |
| KR | 92-0018705 | 10/1992 |
| KR | 96-25591 | 7/1996 |
| KR | 98-0060714 | 11/1998 |

* cited by examiner

*Primary Examiner*—Tho D. Ta
*Assistant Examiner*—Larisa Tsukerman
(74) *Attorney, Agent, or Firm*—Bacon & Thomas, PLLC

(57) ABSTRACT

An electrical plug socket has a socket cover which is defined with first plug insertion holes, a socket body which is defined through an upper wall thereof with second plug insertion holes, terminals which are located inside the socket body, and an opening and closing member which is disposed on the upper wall of the socket body below the socket cover in such a way as to open and close the second plug insertion holes. The electrical plug socket further has a locking device which is installed on the opening and closing member to control movement thereof. The opening and closing member and the locking device are configured in such a way as to be actuated by insertion of a plug into the plug socket.

2 Claims, 7 Drawing Sheets

CONCENTRIC PLUG

TECHNICAL FIELD

The present invention relates to an electrical plug socket, and more particularly, the present invention relates to an electrical plug socket which protects terminals and has a safety device for preventing an accident from occurring due to an electric shock, etc.

BACKGROUND ART

In a conventional electrical plug socket, first plug insertion holes are defined through a socket cover, and second plug insertion holes are defined through a socket body. Terminals are located inside the socket body. An opening and closing member is disposed on the socket body below the socket cover in a manner such that it can open and close the second plug insertion holes while being slidingly moved on the socket body. Inclined surfaces are respectively formed at both ends of the opening and closing member. The opening and closing member is biased by a spring in one direction in which it closes the second plug insertion holes. If connection pins of the plug are inserted through the first plug insertion holes, as distal ends of the connection pins are pressed against the inclined surfaces of the opening and closing member, the opening and closing member is moved in the other direction in such a way as to open the second plug insertion holes. As the second plug insertion holes are opened, the connection pins of the plug can be fully inserted through the second plug insertion holes to be electrically connected with the terminals. In this type of conventional electrical plug socket, since the second plug insertion holes are normally closed by the opening and closing member, foreign material is prevented from entering into the socket body, and contamination of the terminals is avoided. Further, it is possible to inhibit children from tampering with the socket body and avoid occurrence of an accident.

In a variation of the conventional electrical plug socket, the opening and closing member is disposed on the socket body in a manner such that it can open and close the second plug insertion holes while being rotated about a rotation shaft. The opening and closing member is biased at one end thereof by a spring in one rotational direction in which it closes the second plug insertion holes. If connection pins of the plug are inserted through the first plug insertion holes, as distal ends of the connection pins are pressed against the inclined surfaces of the opening and closing member, the opening and closing member is rotated in the other rotational direction in such a way as to open the second plug insertion holes. By this, the connection pins of the plug can be fully inserted through the second plug insertion holes to be electrically connected with the terminals.

However, these conventional electrical plug sockets suffer from defects in that, when children insert metallic rods or the likes through the first plug insertion holes and actively move the metallic rods in leftward and rightward directions or in upward and downward directions, as the opening and closing member for normally closing the second plug insertion holes is unintentionally moved or rotated, the metallic rods can be brought into contact with the terminals in an easy manner, whereby the likelihood of an accident such as an electrical shock to occur is increased.

To cope with this problem, another conventional electrical plug socket has been disclosed in the art. In this plug socket, a recess is defined on an upper surface of the plug socket. An opening and closing plate is rotatably installed on the plug socket in such a way as to cover an upper end of the recess. Guide holes are defined through the opening and closing plate, and plug insertion holes are defined in the recess through the plug socket. The opening and closing plate can be rotated to allow the guide holes to be respectively aligned with or disaligned from the plug insertion holes. The opening and closing plate is biased by a spring in one rotational direction so that the guide holes are normally disaligned from the plug insertion holes to hide, that is, close the plug insertion holes.

In order to couple the plug to the socket, connection pins of the plug are first inserted through the guide holes, and then, the plug and the opening and closing plate are integrally rotated with each other to align the guide holes with the plug insertion holes. When the guide holes are aligned with the plug insertion holes, by pressing the plug, the connection pins can be fully inserted through the plug insertion holes to be electrically connected with terminals. As a consequence, this conventional electrical plug socket still has a drawback in that a procedure for inserting the plug into the socket is complicated.

SUMMARY OF THE INVENTION

Accordingly, the present invention has been made in an effort to solve the problems occurring in the related art, and an object of the present invention is to provide an electrical plug socket which protects terminals, prevents an accident from occurring due to an electric shock, etc, and simplifies a procedure for inserting and coupling a plug therein and thereto.

In order to achieve the above object, according to the present invention, there is provided an electrical plug socket having a socket cover which is defined with first plug insertion holes, a socket body which is defined through an upper wall thereof with second plug insertion holes, terminals which are located inside the socket body, and an opening and closing member which is disposed on the upper wall of the socket body below the socket cover in such a way as to open and close the second plug insertion holes, the electrical plug socket comprising: a locking device installed on the opening and closing member to control movement thereof, the opening and closing member and the locking device being configured in such a way as to be actuated by insertion of a plug into the plug socket.

BRIEF DESCRIPTION OF THE DRAWINGS

The above objects, and other features and advantages of the present invention will become more apparent after a reading of the following detailed description when taken in conjunction with the drawings, in which.

DESCRIPTION OF THE PREFERRED EMBODIMENT

Figure 1:
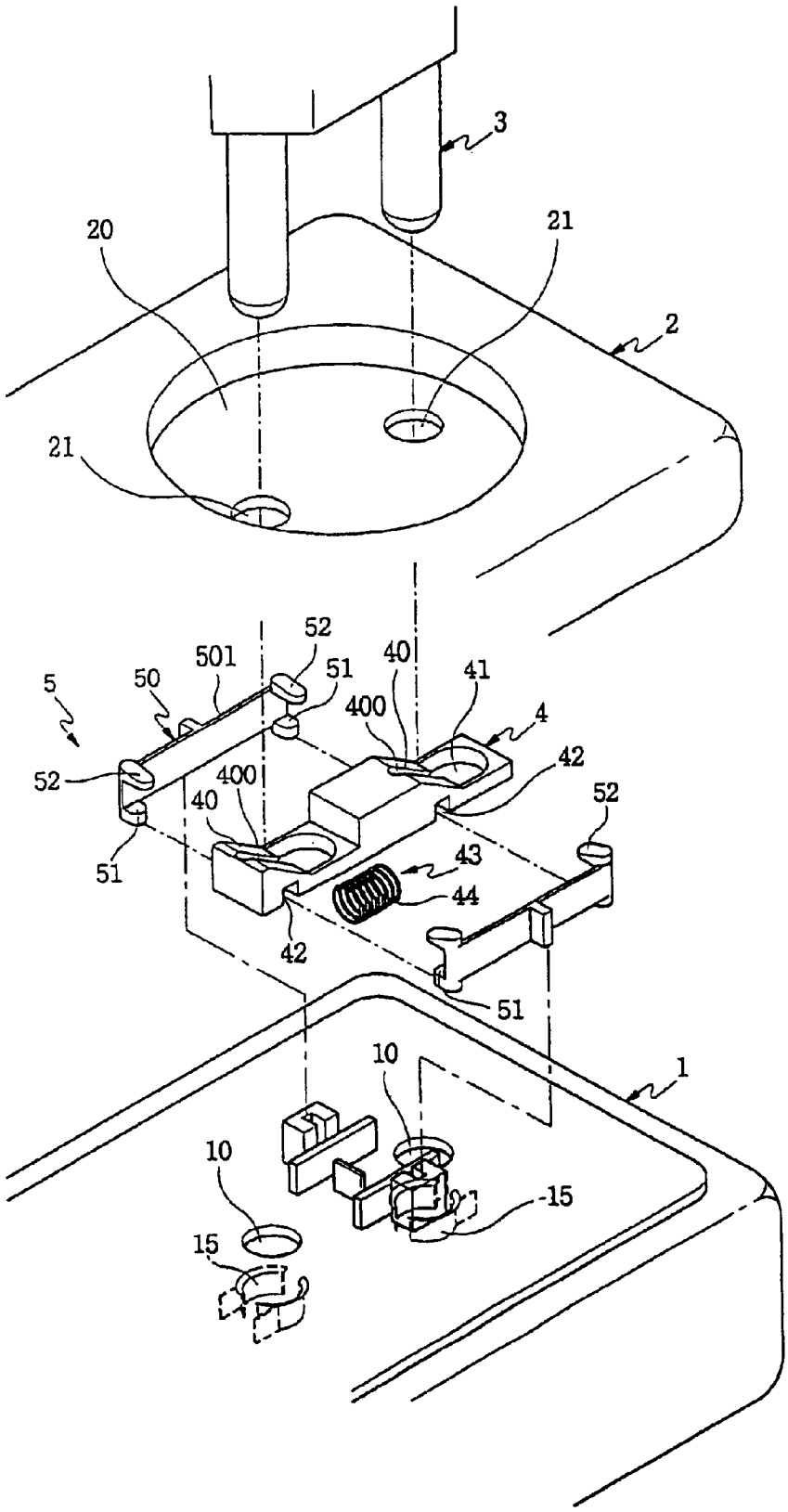
FIG. 1 is an exploded perspective view illustrating an electrical plug socket in accordance with a first embodiment of the present invention.
Figure 2A:
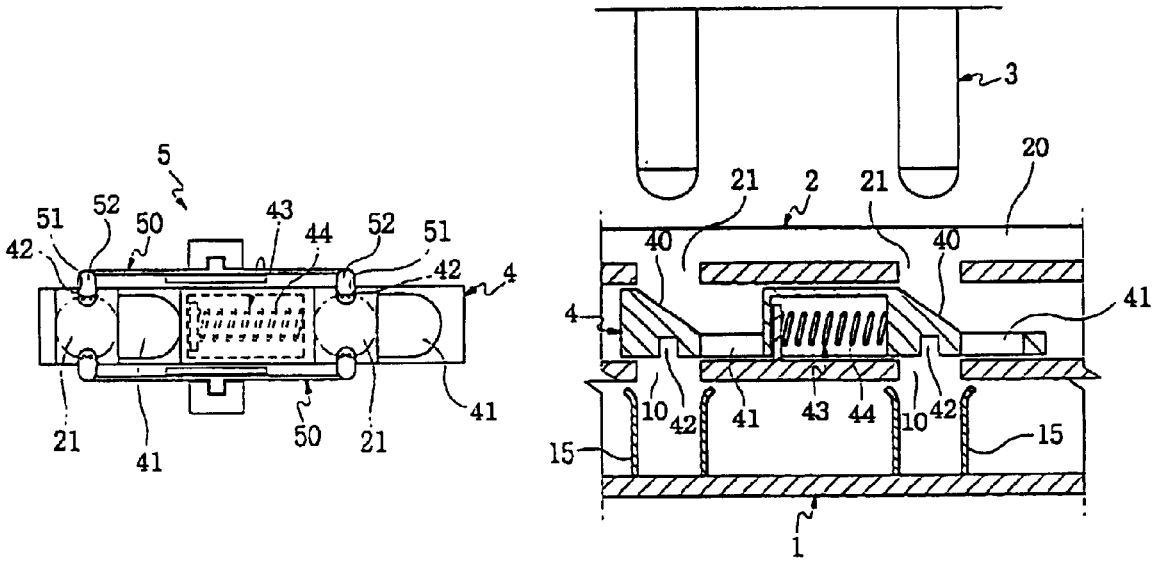
FIGS. 2*a* through 2*c* are cross-sectional views illustrating operations for inserting a plug into the electrical plug socket according to the first embodiment of the present invention.
Figure 2B:
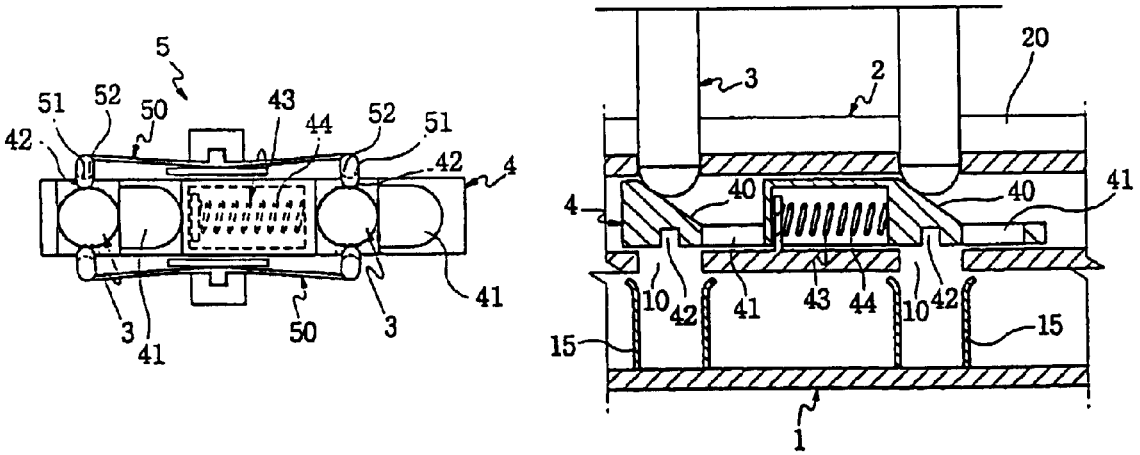
Figure 2C:
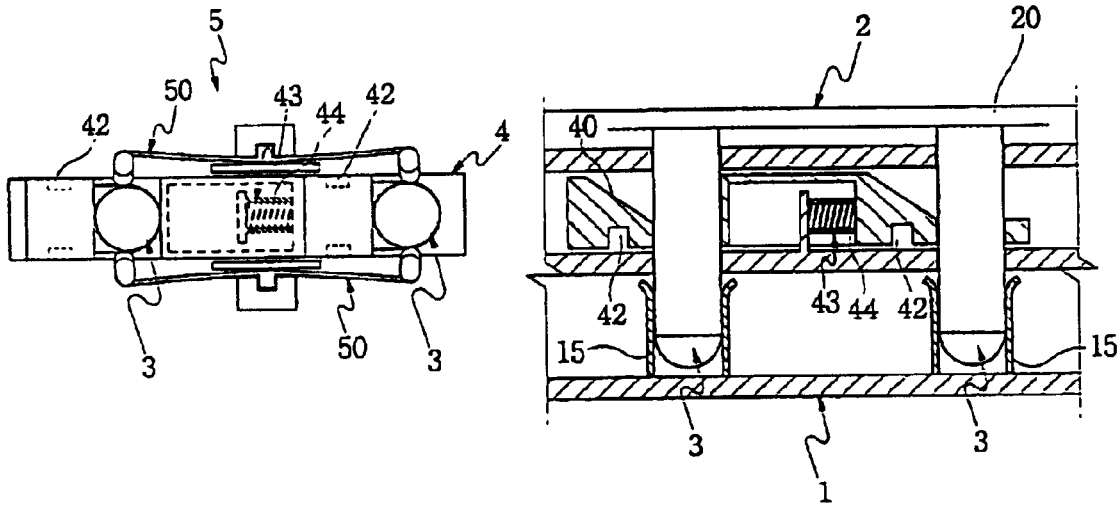

Reference will now be made in greater detail to a preferred embodiment of the invention, an example of which is illustrated in the accompanying drawings. Wherever possible, the same reference numerals will be used throughout the drawings and the description to refer to the same or like parts.

As shown in FIGS. 1 and 2*a* through 2*c*, an electrical plug socket in accordance with a first embodiment of the present invention includes a socket body 1 and a socket cover 2. Two terminals 15 are located inside the socket body 1, and a recess 20 is defined on an upper surface of the socket cover 2. First plug insertion holes 21 are defined through the socket cover 2 in the recess 20, and second plug insertion holes 10 are defined through an upper wall of the socket body 1. An opening and closing member 4 is disposed on the upper wall of the socket body 1 below the socket cover 2 in a manner such that it can open and close the second plug insertion holes 10 while being slidingly moved on the upper wall of the socket body 1. The opening and closing member 4 is biased by elastic means 43 in one direction in which it closes the second plug insertion holes 10. Inclined surfaces 40 are respectively formed at both ends of the opening and closing member 4. The opening and closing member 4 is defined, adjoining lower ends of the inclined surfaces 40, with openings 41. Accordingly, if connection pins of the plug 3 are inserted through the first plug insertion holes 21, when distal ends of the connection pins are pressed against the inclined surfaces 40 of the opening and closing member 4, the opening and closing member 4 is moved in the other direction in such a way as to open the second plug insertion holes 10. As the second plug insertion holes 10 are opened, the connection pins of the plug 3 can be fully inserted into the second plug insertion holes 10 after respectively passing through the openings 41, to be electrically connected with the terminals 15. The electrical plug socket according to the present invention further includes a locking device 5 which is installed on the opening and closing member 4 to control movement thereof. Thus, the locking device 5 is configured in such a way as to prevent the opening and closing member 4 from being unintentionally actuated. The opening and closing member 4 is defined, on a lower surface and adjacent to both ends thereof, with two engaging grooves 42 which extend in a widthwise direction of the opening and closing member 4. The locking device 5 comprises two control sections 50 which render control over movement of the opening and closing member 4. Each control section 50 has a resilient plate 501. Two engaging projections 51 are formed at both ends of a lower edge of the resilient plate 501, and two release projections 52 are formed at both ends of an upper edge of the resilient plate 501. The engaging projections 51 can be engaged into and disengaged from the engaging grooves 42, and the release projections 52 can be positioned on and moved outward of an upper surface of the opening and closing member 4, adjoining the inclined surfaces 40.

Grooves 400 are defined through widthwise middle portions of the inclined surfaces 40 of the opening and closing member 4. Due to the presence of the grooves 400, even when children insert metallic rods or the likes through the first plug insertion holes 21 and actively move the metallic rods, the opening and closing member 4 is prevented from being unintentionally actuated.

Hereinafter, operations of the electrical plug socket according to the present invention, constructed as mentioned above, will be described in detail.

If the connection pins of the plug 3 are inserted through the first plug insertion holes 21 defined through the socket cover 2 in the recess 20, as the distal ends of the connection pins of the plug 3 squeeze the release projections 52 against the upper surface of the opening and closing member 4, the release projections 52 are moved outward. By this, since both ends of each control section 50 are moved outward of the opening and closing member 4, the engaging projections 51 are disengaged from the engaging grooves 42, whereby the opening and closing member 4 is ready to be moved in the other direction. By continued insertion of the plug 3, as the connection pins of the plug 3 are pressed against the inclined surfaces 40 of the opening and closing member 4, the opening and closing member 4 is moved in the other direction, and a spring 44 serving as the elastic means 43 which is arranged in the opening and closing member 4 is compressed in such a way as to develop elastic returning force.

If the connection pins of the plug 3 reach the lower ends of the inclined surfaces 40, as the openings 41 defined through the opening and closing member 4 adjoining the lower ends of the inclined surfaces 40 are aligned with the second plug insertion holes 10, the connection pins of the plug 3 can be fully inserted into the second plug insertion holes 10 after respectively passing through the openings 41, to be electrically connected with the terminals 15.

When the plug 3 is decoupled from the socket body 1, the connection pins of the plug 3 which are electrically disconnected from the terminals 15 are raised while passing through the second plug insertion holes 10 and the openings 41 and being brought into sliding contact with the inclined surfaces 40 of the opening and closing member 4, and the opening and closing member 4 is returned to its initial position by elastic force of the spring 44. If the connection pins of the plug 3 are clear of the first plug insertion holes 21 defined through the socket cover 2, as both ends of each control section 50 which are moved outward of the upper surface of the opening and closing member 4 are returned to their original positions, the engaging projections 51 are engaged again into the engaging grooves 42 defined on the lower surface of the opening and closing member 4, and the release projections 52 are positioned again on the upper surface of the opening and closing member 4.

Figure 3:
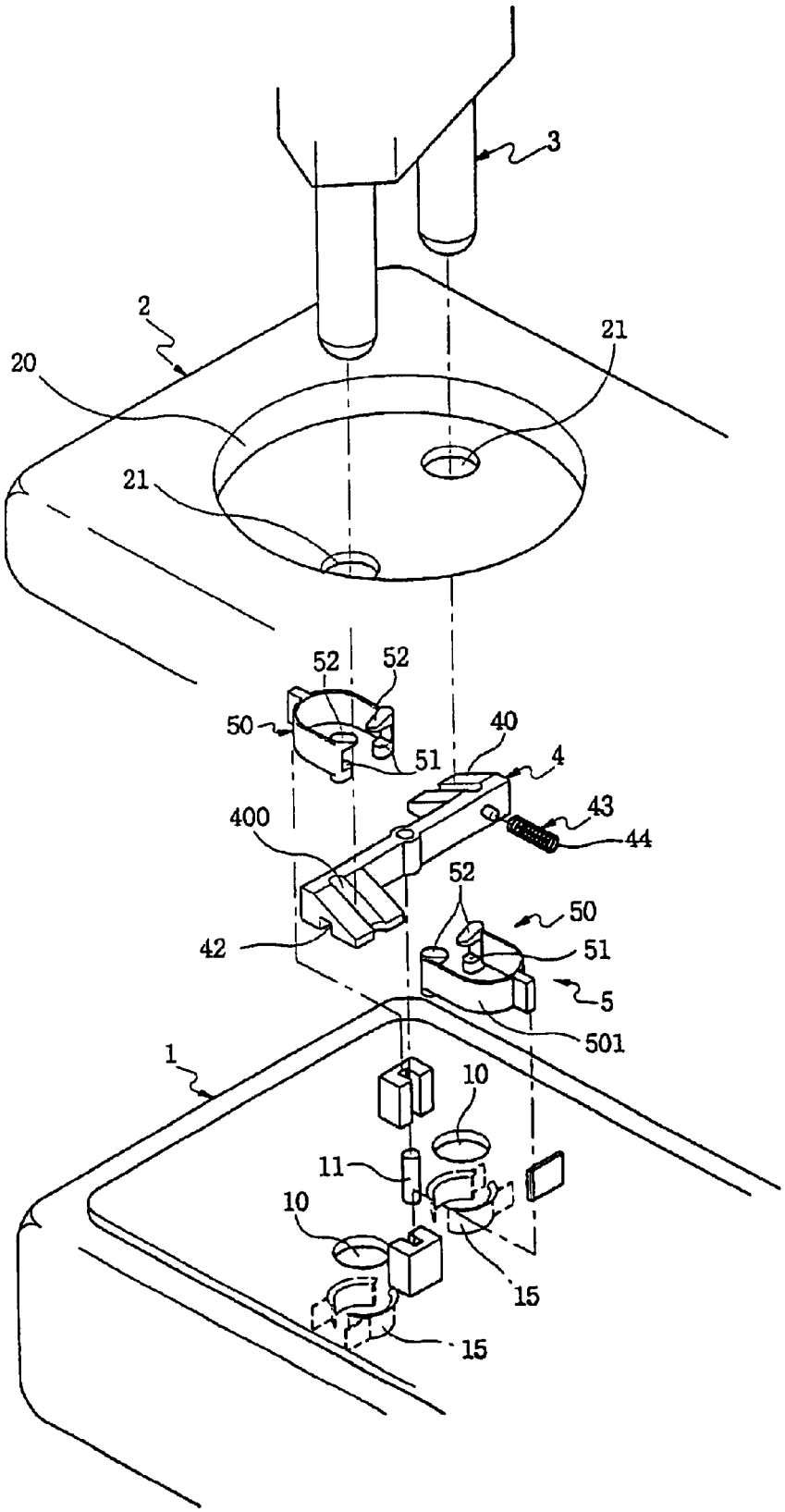
FIG. 3 is an exploded perspective view illustrating an electrical plug socket in accordance with a second embodiment of the present invention.

FIG. 3 is an exploded perspective view illustrating an electrical plug socket in accordance with a second embodiment of the present invention. In this second embodiment, the opening and closing member 4 is configured in a manner such that it can open and close the second plug insertion holes 10 while being rotated about a rotation shaft 11 on the upper wall of the socket body 1. Inclined surfaces 40 are formed at both ends of the opening and closing member 4. Openings 41 are defined through the opening and closing member 4 adjoining lower ends of the inclined surfaces 40. The opening and closing member 4 is biased by elastic means 43 in one rotational direction in which it closes the second plug insertion holes 10. Engaging grooves 42 are defined on a lower surface and adjacent to both ends of the opening and closing member 4. The locking device 5 comprises two control sections 50. Each control section 50 comprises a resilient plate 501. Two engaging projections 51 which can be engaged into or disengaged from the engaging grooves 42 are formed at both ends of a lower edge of the resilient plate 501, and two release projections 52 which can be positioned on or moved outward of an upper surface of the opening and closing member 4 are formed at both ends of an upper edge of the resilient plate 501.

Describing operations of the electrical plug socket according to this embodiment, if the connection pins of the plug 3 are inserted through the first plug insertion holes 21, as the distal ends of the connection pins of the plug 3 squeeze the release projections 52 against the upper surface of the opening and closing member 4, the release projections 52 are moved outward. By this, since both ends of each control section 50 are moved outward of the opening and closing member 4, the engaging projections 51 are disengaged from the engaging grooves 42, whereby the opening and closing member 4 is ready to be rotated in the other rotational direction. By continued insertion of the plug 3, as the connection pins of the plug 3 are pressed against the inclined surfaces 40 of the opening and closing member 4, the opening and closing member 4 is rotated in the other rotational direction. Then, as the openings 41 are aligned with the second plug insertion holes 10, the connection pins of the plug 3 can be fully inserted into the second plug insertion holes 10 after respectively passing through the openings 41, to be electrically connected with the terminals 15.

Figure 4A:
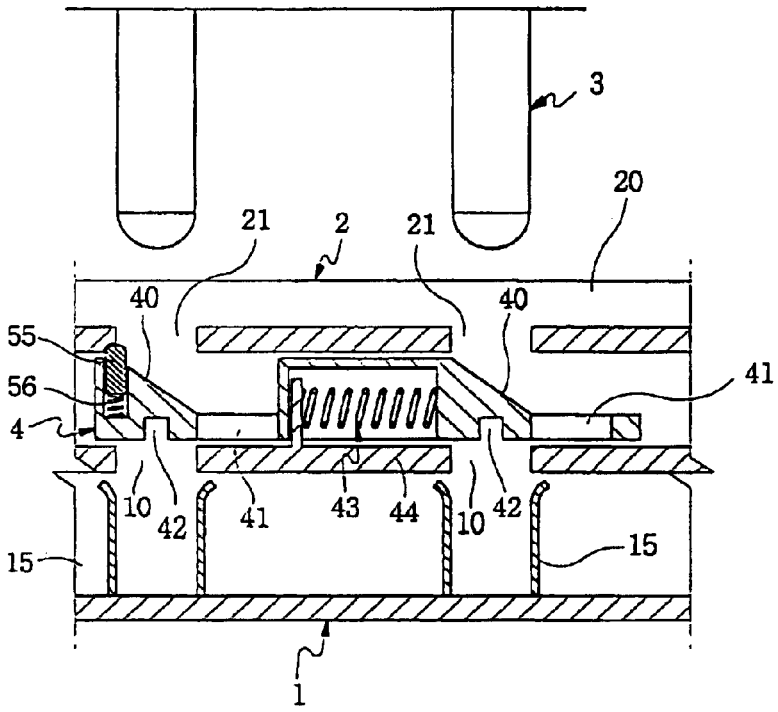
FIGS. 4*a* through 4*c* are cross-sectional views illustrating operations for inserting a plug into an electrical plug socket in accordance with a third embodiment of the present invention.
Figure 4B:
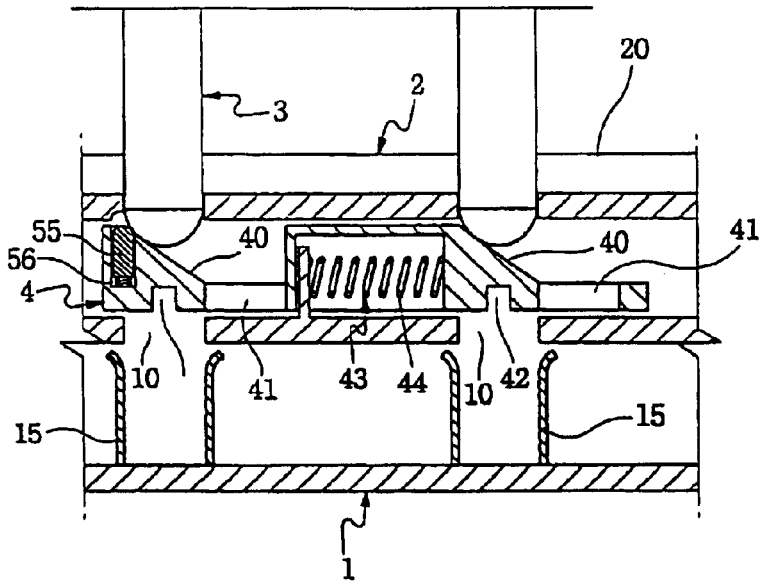
Figure 4C:
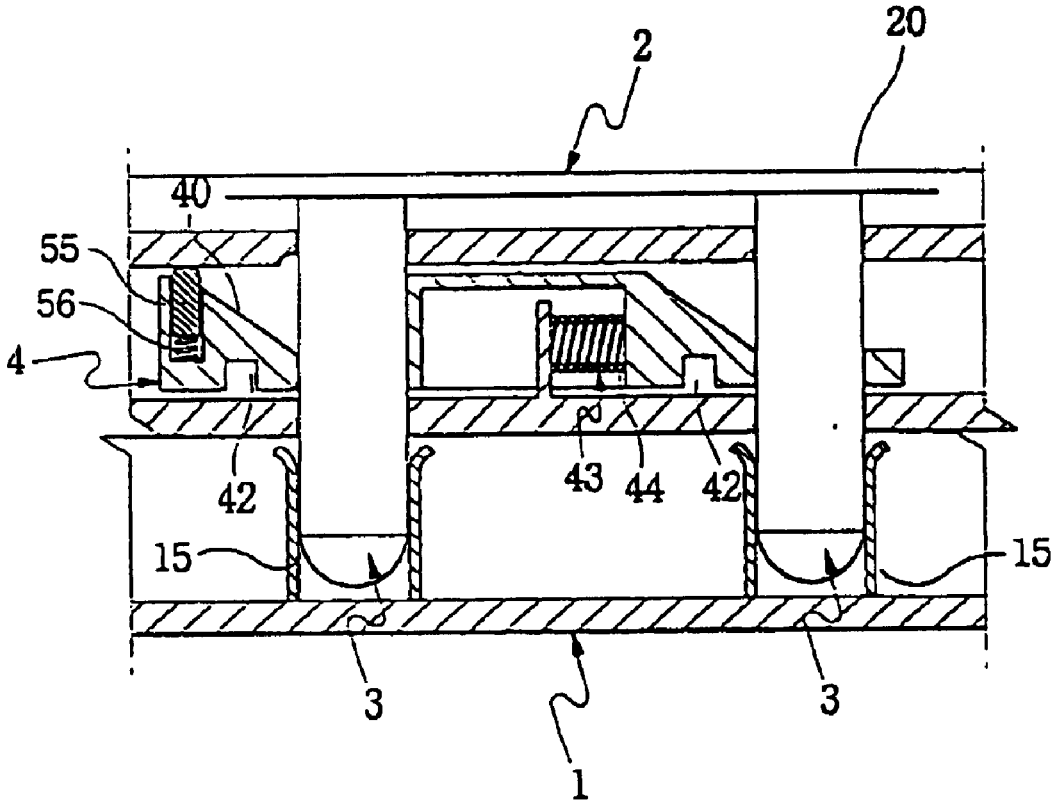

FIGS. 4*a* through 4*c* are cross-sectional views illustrating operations for inserting a plug into an electrical plug socket in accordance with a third embodiment of the present invention. In this embodiment, the opening and closing member 4 can open and close the second plug insertion holes 10 while being slidingly moved on the upper wall of the socket body 1. Inclined surfaces 40 are formed at both ends of the opening and closing member 4. Openings 41 are defined through the opening and closing member 4 adjoining lower ends of the inclined surfaces 40. The opening and closing member 4 is biased by elastic means 43 in one direction in which it closes the second plug insertion holes 10. The locking device 5 comprises an engaging pin 55. The engaging pin 55 is accommodated in a bore defined in the opening and closing member 4 adjoining an upper end of the inclined surface 40 and is biased upward by a spring 56 against a lower surface of the socket cover 2 and partly exposed to the first plug insertion hole 21.

Describing operations of the electrical plug socket according to this embodiment, if the connection pins of the plug 3 are inserted through the first plug insertion holes 21, the engaging pin 55 is lowered while compressing the spring 56. When the engaging pin 55 is disengaged from a shoulder which is formed on a circumferential inner surface of the socket cover 2 which defines the plug insertion hole 21, the connection pins of the plug 3 are pressed against the inclined surfaces 40 of the opening and closing member 4, and the opening and closing member 4 is moved in the other direction. Then, as the openings 41 are aligned with the second plug insertion holes 10, the connection pins of the plug 3 can be fully inserted into the second plug insertion holes 10 after respectively passing through the openings 41, to be electrically connected with the terminals 15.

Figure 5:
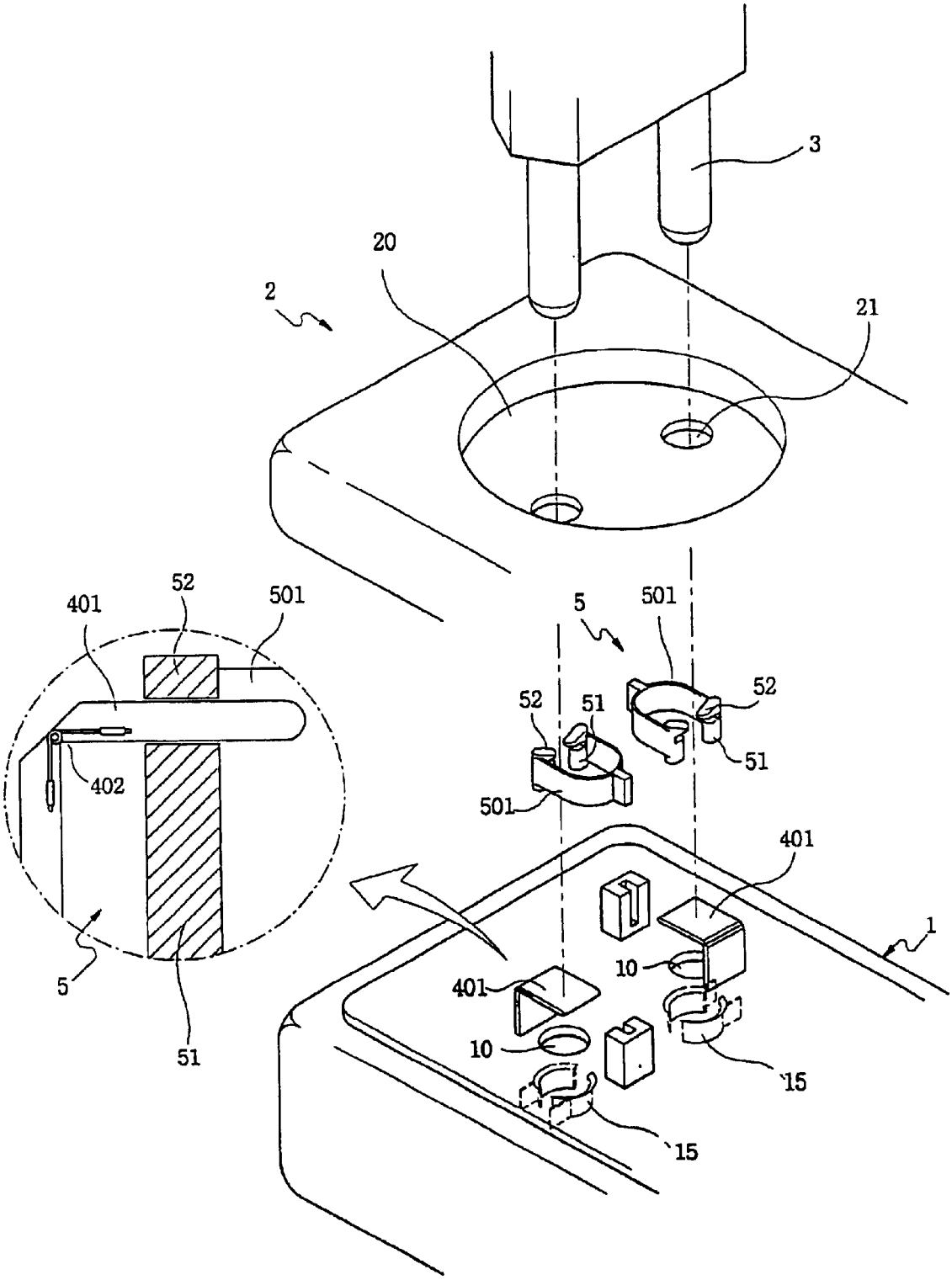
FIG. 5 is a partially enlarged exploded perspective view illustrating an electrical plug socket in accordance with a fourth embodiment of the present invention.

Other than the above-described embodiments, the present invention can be embodied as shown in FIG. 5. That is to say, in this embodiment, the opening and closing member 4 comprises opening and closing plates 401 which are installed in a manner such that they can be pivoted within a predetermined angle. The opening and closing plates 401 can open and close the second plug insertion holes 10 while being pivoted about their hinge shafts. The opening and closing plates 401 are biased by elastic means 402 in one pivoting direction in which they close the second plug insertion holes 10. The locking device 5 comprises two control sections. Each control section comprises a resilient plate 501. Two engaging projections 51 for supporting the opening and closing plate 401 and two release projections 52 for being actuated by the plug 3 are formed at both ends of the resilient plate 501. Both side edges of the opening and closing plate 401 can be engaged into or disengaged from spaces defined between the engaging projections 51 and the release projections 52. Therefore, in this embodiment, the opening and closing plate 401 cannot be pressed by the plug 3 to be pivoted in the other pivoting direction until the engaging projections 51 are disengaged from the opening and closing plate 401.

As a result, the electrical plug socket according to the present invention provides advantages in that, since it is impossible to simultaneously apply manipulating force to four release projections even when foreign articles other than a standardized plug are inserted into the plug socket and to move an opening and closing member, exposure of terminals is prevented, and occurrence of an accident due to an electric shock is avoided. Further, because connection pins of a plug can be coupled to terminals only by pressing the plug as in the conventional method, a procedure for inserting and coupling the plug into and to the socket is simplified.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. An electrical plug socket, having:

a socket cover which is defined with first plug insertion holes;

a socket body including an upper wall with second plug insertion holes defined through said upper wall;

terminals which are located inside the socket body;

an opening and closing member which is disposed on said upper wall of the socket body and below said socket cover in such a way as to open and close said second plug insertion holes; and a locking device installed on said opening and closing member to control movement thereof, said opening and closing member and said locking device being configured in such a way as to be actuated by insertion of a plug into the plug socket wherein:

said opening and closing member can open and close said second plug insertion holes while being slidingly moved on said upper wall of the socket body, incline surfaces are formed at both ends of said opening and closing member, with openings defined through said opening and closing member adjoining the lower ends of said incline surfaces, said opening and closing member being biased by elastic means in one direction in which it closes said second plug insertion holes, and said locking device having an engaging pin which is accommodated in a bore defined in said opening and closing member adjoining an upper end of the incline surfaces and is biased by a spring against a lower surface of said socket cover and partly exposed to the first plug insertion hole.

2. The electrical plug socket as defined in claim 1, wherein:

grooves are defined through said opening and closing member to prevent said opening and closing member from being unintentionally actuated.

* * * * *